United States Patent [19]

Heggart et al.

[11] Patent Number: 4,715,042

[45] Date of Patent: Dec. 22, 1987

[54] FURNACE COOLING SYSTEM AND METHOD

[75] Inventors: Ronald G. Heggart, Caledonia; Willard K. McClintock, Edison; Randy J. Engstrom, Marion, all of Ohio

[73] Assignee: Union Carbide Corporation, Danbury, Conn.

[21] Appl. No.: 900,168

[22] PCT Filed: Oct. 15, 1985

[86] PCT No.: PCT/US85/01977

§ 371 Date: Aug. 8, 1986

§ 102(e) Date: Aug. 8, 1986

[87] PCT Pub. No.: WO86/02436

PCT Pub. Date: Apr. 24, 1986

[51] Int. Cl.[4] ..... F27D 1/12

[52] U.S. Cl. ..... 373/74; 373/76

[58] Field of Search ..... 373/73, 74, 75, 76, 373/113, 165; 266/140, 159, 901, 117, 192; 432/233; 202/117

[56] References Cited

U.S. PATENT DOCUMENTS

| | | | |
|---|---|---|---|
| 1,840,247 | 1/1932 | Northrup . | |
| 3,388,737 | 6/1968 | Buckwalter et al. . | |
| 3,429,973 | 2/1969 | Carter et al. . | |
| 3,858,861 | 1/1975 | Jernigan | 266/32 |
| 4,107,449 | 8/1978 | Sosonkin et al. . | |
| 4,132,852 | 1/1979 | Andoniev et al. . | |
| 4,197,422 | 4/1980 | Fuchs . | |
| 4,216,348 | 8/1980 | Greenberger . | |
| 4,239,484 | 12/1980 | Schuster | 432/77 |
| 4,273,949 | 6/1981 | Fischer et al. . | |
| 4,345,332 | 8/1982 | Wronka | 373/74 |
| 4,443,188 | 4/1984 | Buhler | 432/233 |
| 4,494,594 | 1/1985 | Kurzinski | 164/443 |
| 4,633,480 | 12/1986 | Bleimann | 373/74 |

FOREIGN PATENT DOCUMENTS

| | | |
|---|---|---|
| 1108372 | 6/1961 | Fed. Rep. of Germany . |
| 3027465 | 3/1982 | Fed. Rep. of Germany . |
| 45-29728 | 9/1970 | Japan . |
| 57-48615 | 10/1982 | Japan . |

OTHER PUBLICATIONS

"World Steel and Metalworking", vol. 7, 85/86, pp. 106–109 George Hess.

*Primary Examiner*—Roy N. Envall, Jr.
*Attorney, Agent, or Firm*—C. F. O'Brien

[57] ABSTRACT

A spray cooling system for cooling a furnace for the melting or treatment of molten metal, and particularly the roof and/or sidewall of electric-arc, plasma-arc and ladle furnaces. Other types of metal treating furnaces and accessory equipment may also be cooled with the system of the invention. In the invention, spray headers and pipes (14, 16, 18) supply coolant to spray nozzles (70) distributed within a coolant space in a roof structure (10) to spray coolant against the working plates (22) of the roof. The spray pipes and headers also comprise part of the framework for the roof, resulting in a simple, lightweight, one-piece structure. A pump (56) is connected to evacuate the coolant from the coolant space, and thermocouples (58) are embedded in the working plates to monitor their temperature and operate controls to adjust the flow rate so that only the amount of coolant necessary to maintain a desired temperature is supplied to the roof. The sprays of coolant produce many small droplets which provide a large surface area for more effective cooling, and at least a substantial portion of the droplets are vaporized during cooling whereby the latent heat of vaporization of the coolant is utilized to provide a significantly increased cooling rate. Similar arrangements may be used to cool the delta and/or sidewall of the furnace.

The method of cooling a furnace by directing sprays of coolant against the working plates is also disclosed.

26 Claims, 15 Drawing Figures

FURNACE COOLING SYSTEM AND METHOD

TECHNICAL FIELD

This invention relates generally to the cooling of furnaces, and more particularly, to an improved system for cooling the roof and/or side wall of electric-arc, plasma-arc and ladle furnaces.

The invention further relates to an improved method for cooling the roof and/or side walls of furnaces, particularly electric-arc, plasma-arc and ladle furnaces, and the fume hoods of basic oxygen vessels.

BACKGROUND ART

In conventional furnaces for the melting of metal or for the treatment of molten metal, the furnace roof is typically either lined with a refractory material or is constructed of steel panels with enclosed, circulating cooling water systems embedded therein. In the latter, the cooling water is circulated at high volume and under pressure.

Examples of some typical prior art systems are described in U.S. Pat. Nos. 205,274 (1878), 1,840,247, 4,015,068, 4,107,449, 4,132,852, 4,197,422, 4,216,348, 4,273,949, 4,345,332, 4,375,449, 4,410,996, 4,411,311, 4,423,513, 4,425,656 and 4,449,221; German patent specifications Nos. 30 27 465.8-24 and 1 108 372; and Japanese patent application publications Nos. 57-48615 and 45-29728.

The structure in U.S. Pat. No. 4,410,996 employs sidewall refractories as well as a suspended refractory roof in which the suspension members are water cooled pipes. The only spray cooling disclosed in this patent is at the side wall gas exhaust ducts 11*a* and 11*b*, and the spray is intended to cool the gasses exiting the ducts.

The NORTHRUP U.S. Pat. No. (1,840,247) and KELLER, et al U.S. Pat. No. (4,449,221) both disclose furnaces in which sprays of cooling water are directed against metal plates in the side walls of the furnace to cool refractory material carried by the plates and prolong the life of the refractory material.

The SOSONKIN et al U.S. Pat. No. (4,107,449) discloses a furnace in which refractory material lines the roof and side wall, and in which water is circulated through distinct roof panels or sections to cool the roof. In FIG. 7, a part of the water supply system is shown and in column six, lines 5 through 8, pipes 27 with holes 28 are described as directing streams of water onto the roof panels. There is no disclosure of a spray. It is believed that cooling of the roof in this patent is accomplished by flooding the surface to be cooled.

U.S. Pat. Nos. 205,274 and 4,411,311 both disclose blast furnace cooling systems in which discrete sections are provided in the side walls of the furnace with water circulated therethrough to cool the refractory material.

U.S. Pat. Nos. 4,015,068 and 4,375,449 both describe arrangements in which cooling water is caused to flow over the outer surface of furnaces.

The remaining patents dislcose systems in which the cooling water is circulated in closed systems through pipes, panels, etc. In these systems, the cooling water is circulated in large volumes under high pressures. These systems must be carefully maintained and operated since any blockage of coolant water flow can result in flashing of the water to steam, causing a sudden and dangerous increase in pressure which may cause failure of the roof and an explosion when the water flows into the molten metal. Similar consequences may follow in the event of a leak developing in the cooling system, particularly in view of the large volumes of water and high pressures in the cooling systems.

DISCLOSURE OF THE INVENTION

Accordingly, it is a principal object of the invention to provide an inexpensive and lightweight system for spray cooling the working plates of furnaces and furnace components, in which the danger of leakage of cooling fluid into the furnace is reduced and the rate of cooling is improved relative to prior art systems.

Another object of the invention is to provide a spray cooling system for cooling the working plates of furnaces and furnace components, in which a spray of cooling fluid such as water is sprayed onto the plates, the large surface area of the spray droplets significantly increasing the cooling effectiveness over flood cooling, and wherein the cooling fluid is evacuated from the space after being sprayed onto the plates.

A further object of the invention is to provide a system of cooling the working plates of furnaces and furnace components, in which a spray header system extends in a cooling space for introducing sprays of cooling fluid therein, and the spray header system comprises a framework for supporting the plates, thus producing a simple, lightweight, one-piece structure.

Yet another object of the invention is to provide a cooling system in which the need for refractory lining on the side wall and roof or other component of a furnace is eliminated.

These and other objects and advantages of the invention are accomplished by the improved structure and method discovered by applicants for cooling furnaces, particularly electric-arc, plasma-arc and ladle furnaces and basic oxygen vessels. The invention also has potential applications in arc furnace exhaust ports and feed openings; iron mixer (holding) vessel roofs; and BOF hoods.

In accordance with the present invention, inner or working plates or panels are exposed to the heat of the interior of the furnace or furnace component, and outer cover plates are spaced from the inner plates, defining an enclosed cooling space or chamber. Sprays of coolant fluid are directed against the inner or working panels of the roof and/or side wall or other component of the furnace. These panels are made of steel and preferably have a plurality of studs on their inner surfaces for trapping molten slag as it splatters against the plate during operation of the furnace. However, the need for manufactured refractory lining on the side wall and roof a furnace cooled in accordance with the invention is eliminated. This means that there is no need to place a separate lining of manufactured refractory material, such as refractory brick, for example, on the steel plates, although it is to be understood that molten slag within the furnace will form an insulating lining on the plates during operation of the furnace, as noted above.

The cooling system comprises an arrangement of spray headers disposed substantially uniformly with respect to the plates for spraying coolant fluid against them, and coolant evacuating means for positively removing or evacuating the coolant from the coolant space or chamber. The positive extraction or evacuating means for the coolant ensures that the coolant is quickly and effectively removed from the coolant space after it is sprayed against the working plates, thereby avoiding any potentially detrimental movement and localized collection of the coolant fluid when the furnace is tilted. This is not true of prior art spray cooled systems, which do not have a positive evacuation means.

The coolant fluid is preferably water or a water base fluid, and is sprayed in a quantity such that the spray droplets absorb heat due to surface area contact and "dance" or move across the plate and are positively exhausted or evacuated as droplets. Thermocouples are embedded in the plates to measure their temperature and these are connected with suitable controls to adjust the rate of coolant flow to maintain the desired temperature. The droplets of coolant fluid produced by the spray system provide a very large surface area, resulting in a large cooling capacity. Moreover, although the temperature of the coolant fluid (water) normally does not reach 212° F., if it does reach such temperature due to the occurrence of a temporary hot spot, or the like, it flashes, whereby the latent heat of vaporization of the coolant is used in cooling the working plates, resulting in a calory removal ten times greater than can be achieved with flood cooling.

The system of the invention is thus highly efficient, using significantly less water than prior art systems. For instance, in one example using the system of the invention, only about one half as much coolant is used as in a typical prior art system. This significant reduction in the amount of coolant water required is particularly important for some metal producers who do not have the water or water systems necessary for the water cooled systems currently available. Moreover, the scrubbing action of the sprays against the working plates keeps the plate surface clean, thereby enhancing cooling effectiveness and prolonging the life of the furnace and/or components. In prior art systems, scale and sludge tend to build up either in pipes or within the enclosed fabrication, requiring frequent cleaning in order to maintain effective cooling.

Significantly less maintenance is required with the invention than is required with prior art pressurized systems. For instance, if the water temperature exceeds about 140° F. in a prior art pressurized system, precipitates will settle out, causing scaling and buildup of the surface to be cooled, reducing cooling efficiency. Further, if the water temperature exceeds about 212° F. in a prior art pressurized system, steam can be generated, creating a dangerous situation with the possibility of explosion. If the water pressure is reduced with these prior art systems, solids tend to settle out of the water, reducing effective cooling and ultimately causing the section to fail. Also, loss of pressure further enhances steam formation. None of these problems exist with the invention. As noted previously, the sprays of water have a scrubbing effect on the surface being cooled, tending to keep it clean of scale, etc. Moreover, the system of the invention is only under sufficient pressure to effect a spray, and access to the cooling space or plates is convenient, enabling easy cleaning or repair when necessary. Prior art systems, on the other hand, comprise individual panels which must be removed and flushed to preserve their life. Also, such prior art systems require a substantial number of hoses, pipes, valves and the like to connect and disconnect and maintain. Further, the absence of refractory lining from the structure according to the invention eliminates both the weight and expensive and time-consuming maintenance required in furnaces with refractory linings.

Since the spray cooling system of the invention is only under minimal pressure, and only the amount of water necessary to maintain the integrity of the working plate is provided to the coolant space in response to the actual temperature of the working plate as measured by the thermocouples, there is very little chance of an explosion occurring in the event of a leak developing in the system. Accordingly, the spray cooling system of the invention is significantly more safe than prior art pressurized systems. In fact, since the cooling fluid is evacuated from the coolant space in the invention, and since the cooling fluid is not under pressure, there is very little liklihood of any cooling fluid leaking into the furnace.

The initial capital cost of a roof having the cooling system of the invention incorporated therein is also very low. For instance, systems currently available require extensive in-house preparatory work at substantial cost. Included are piping, stainless steel hoses, water valves, and spare panels for the roof. These costs can easily reach 60% of the initial cost of the roof itself. With the present invention, these costs are less than about 10% of the cost of the roof. Additionally, the unique structure of the spray cooled roof of the invention makes it lightweight, the roof weighing only about one-third as much as a refractory roof and being substantially lighter than the pressurized water cooled roofs currently available. The roof of the invention is also of one-piece design, thereby offering full containment of hot gasses and flame and other emissions. The pressurized systems currently on the market, on the other hand, are comprised of individual removable panel sections. This structure inherently results in gaps between the panels, through which flame and hot gasses may escape, with potential damage to the upper furnace structure. Other pollutants may also escape the furnace environment through these gaps. The absence of gaps in the roof of the invention eliminates these problems and also prevents outside air from being drawn into the furnace, where it would oxidize the electrodes and increase KWH consumption. Moreover, the relatively low profile of the roof of the invention results in decreased oxidation of the electrodes, since less of the electrodes are exposed within the confines of the roof.

The roof of the invention is thus expected to have a long life, being capable of producing more heats than a typical prior art roof. This increased life is at least partially due to having complete and easy access to the face of the working plate which is exposed to the cooling water sprays, permitting the plate to be kept free of the dirt and built-up deposits that shorten the life of the pressurized systems. The lightweight structure of the roof of the invention also reduces stress on gantry supports and the like, prolonging their life and reducing maintenance on associated furnace components. Moreover, the evacuation means for evacuating the coolant fluid from the coolant space does not require any additional energy sources or expensive pumps and motors. Instead, a simple venturi is operated from the dischage liquid from another area of the furnace to draw the coolant fluid from the coolant space through strategically placed slots and/or scavenger suction pipes, as required.

Tne system developed by the applicants is thus superior to prior art systems because of its increased efficiency, reduced capital requirements and operating costs, and greatly enhanced safety features.

BRIEF DESCRIPTION OF THE DRAWINGS

These and other objects and advantages of the invention will become apparent from the following detailed description and accompanying drawings, in which like reference characters designate like parts throughout the several views, and wherein.

BEST MODE FOR CARRYING OUT THE INVENTION

Figure 1:
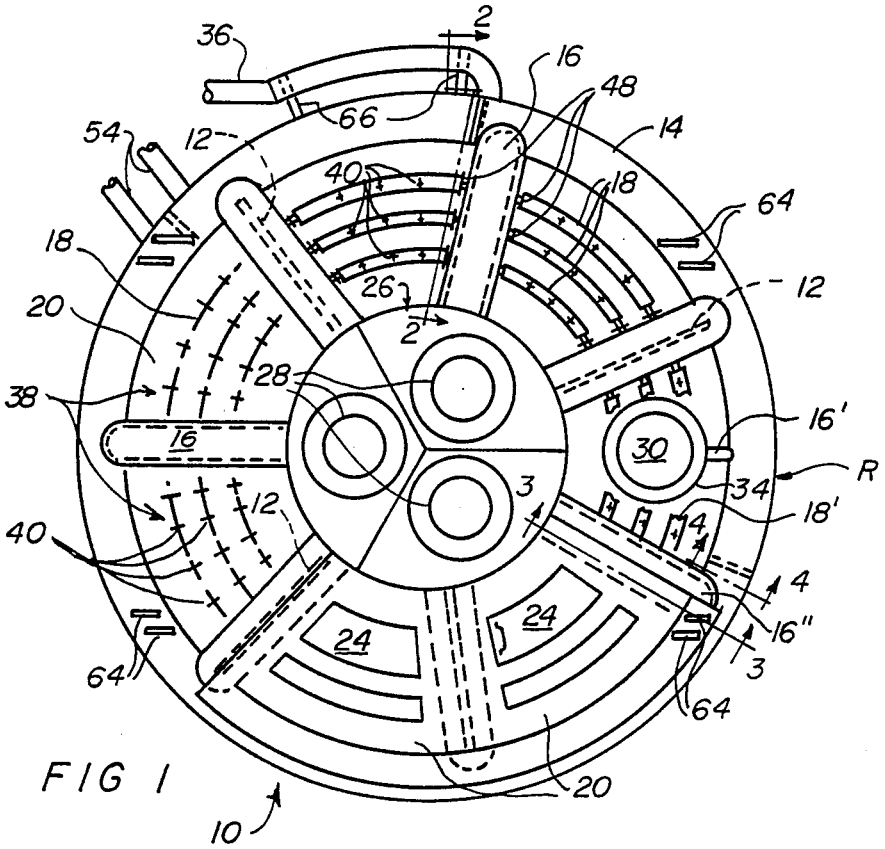
FIG. 1 is a top plan view, with portions removed, of a roof embodying the cooling system of the invention.

Referring more specifically to the drawings, an apparatus in accordance with a first form of the invention is indicated generally at 10 in FIG. 1, and comprises furnace roof structure R having a framework formed of a combination of I-beams 12 and a spray system including a ring-shaped primary header 14 at the outer periphery of the roof, radially extending secondary headers 16, and circumferentially extending spray pipes 18. Cover plates 20 are secured on top of the framework, and bottom or working plates 22 are secured to the bottom of the framework. Access hatches 24 are preferably provided through the cover plates 20 for gaining access to the spray system for maintenance, inspection, and the like. The working plates are cooled by water sprayed thereon from the spray system.

The center portion of the roof structure includes a delta 26 having means for supporting a plurality of electrodes 28, and a vent stack opening 30 is formed through one sector of the roof. A delta support plate 32 extends around the delta, and an annular spray ring 34 extends around the vent stack opening for spraying coolant against the vent stack. Water is supplied to the spray ring 34 via pipe 16' connected with the primary header 14.

Figure 2:
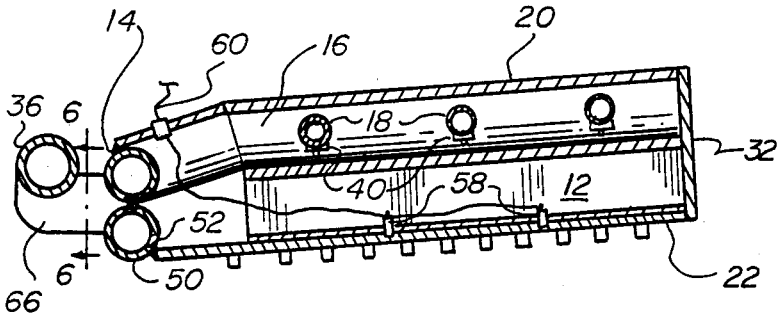
FIG. 2 is an enlarged vertical sectional view taken along line 2—2 in FIG. 1.
Figure 3:
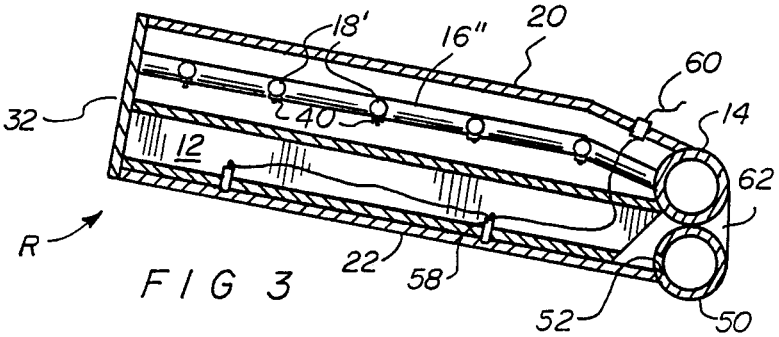
FIG. 3 is an enlarged vertical sectional view taken along line 3—3 in FIG. 1.

As seen best in FIGS. 1, 2 and 3, coolant fluid, i.e., water, is supplied to the spray system via a main water feed pipe 36 to the ring-shaped primary header 14 extending around the periphery of the roof. The plurality of radially inwardly extending secondary headers 16 lead from the header 14 to the delta support plate 32 at the periphery of the delta 26. The series of circumferentially extending spray pipes 18 project from either side of each secondary header 16 and extend into close proximity with a radially extending I-beam 12, several of which are spaced around the roof. The secondary headers 16 and I-beams 12 divide the roof into six substantially equally sized zones 38. The primary and secondary headers, together with the I-beams define a frame for the roof structure, and support the top or cover plates 20 and the bottom or working plates 22.

Figure 6:
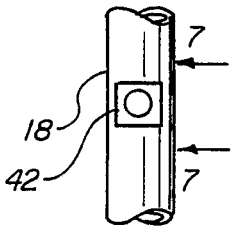
FIG. 6 is an enlarged fragmentary view taken along line 6—6 in FIG. 2.
Figure 7:
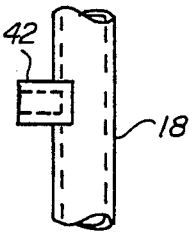
FIG. 7 is a fragmentary view taken along line 7—7 in FIG. 6.
Figure 8:
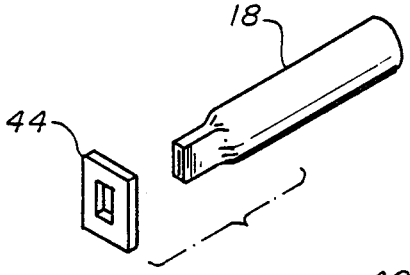
FIG. 8 is a fragmentary, exploded perspective view of the free end of one of the spray pipes, showing the bracket for supporting the free end.

A plurality of spray nozzles 40 are fixed to each spray pipe 18 by means of suitable fittings, such as shown at 42 in FIGS. 6 and 7. The free ends of the spray pipes are supported from the I-beams 12 by brackets 44 fixed to the I-beams and having an opening therein in which the flattened ends 46 of the spray pipes are inserted. The other ends of the spray pipes are connected to the secondary headers by suitable quick-disconnect couplings 48, such as a conventional cam-lock device (not shown in detail).

Figure 4:
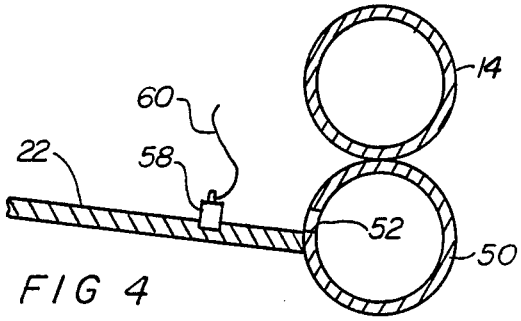
FIG. 4 is a greatly enlarged, fragmentary vertical sectional view taken along line 4—4 in FIG. 1.

As seen best in FIGS. 2, 3 and 4, a second annular or ring-shaped outlet conduit 50 extends around the periphery of the roof underneath the primary header 14. The lower edge of the bottom plate of the roof is joined to this conduit 50 at approximately the midportion thereof, and in one embodiment of the invention, coolant fluid outlet openings or slots 52 are formed in the side of this conduit for evacuating the coolant fluid away from the coolant space between the cover plates and bottom plates. One or more outlet pipes 54 extend away from the conduit 50 and lead to a pump means 56 (FIG. 15) for withdrawing the coolant from the coolant space by evacuation.

It will be noted in FIG. 3 that the secondary header 16'' in this zone is smaller in diameter than the other secondary headers 16, since the presence of the vent stack 30 enables much shorter spray pipes 18' to be used.

As shown somewhat schematically in FIGS. 2 and 3, thermocouples 58 are embedded in the working plates for monitoring the temperature of the plates. The thermocouples are connected via wires 60 with suitable controls (not shown) to adjust the rate of flow of coolant to any or all sections of the roof or other structure being cooled to maintain a desired temperature.

Figure 5:
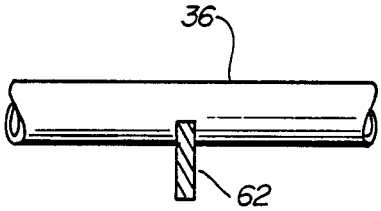
FIG. 5 is a view in section taken along line 5—5 in FIG. 2.

Reinforcing gusset plates 62 are welded to the rings 14 and 50 at spaced points around the circumference of the roof, and as seen in FIG. 1, lift hooks or brackets 64 are provided at several spaced locations on the roof for lifting and supporting the roof. Moreover, as seen in FIGS. 2 and 5, the water feed pipe 36 is supported by a pair of brackets 66.

Figure 9:
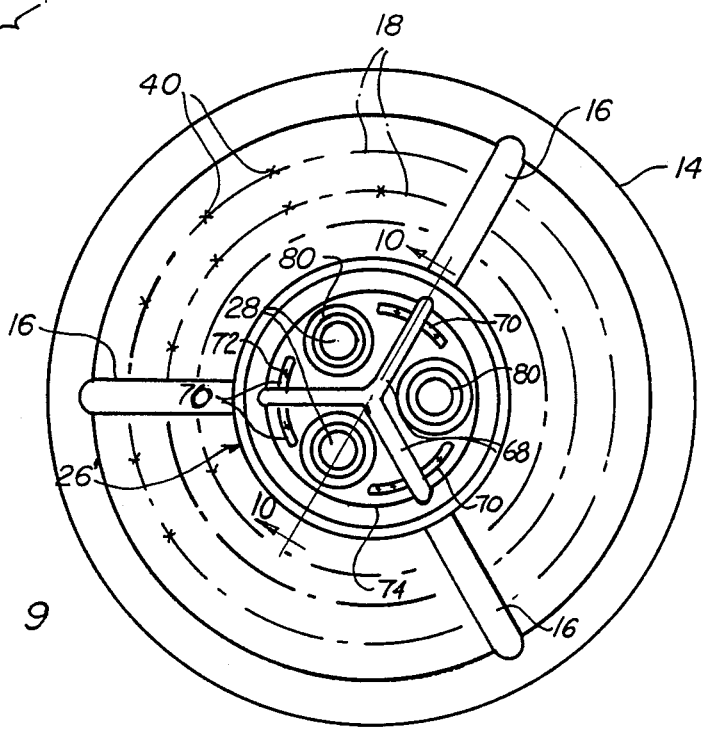
FIG. 9 is a plan view similar to FIG. 1 of a modification of the invention, wherein the delta is spray-cooled similarly to the rest of the roof.
Figure 10:
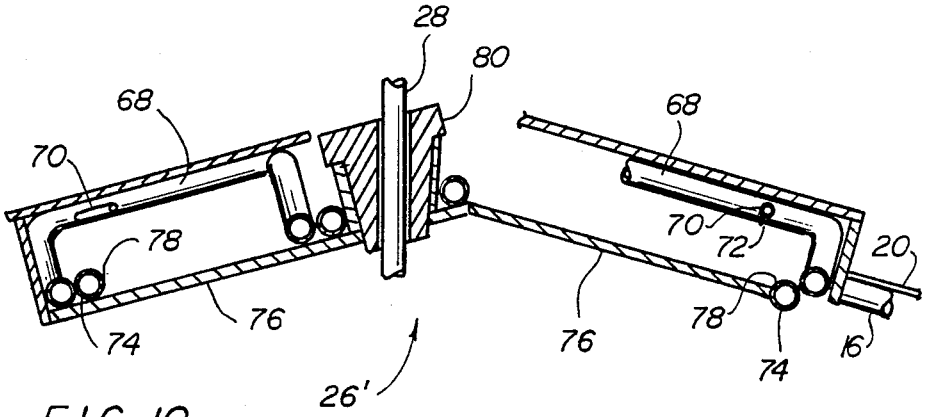
FIG. 10 is an enlarged, fragmentary vertical sectional view taken along line 10—10 in FIG. 9.

A modification of the invention is shown in FIGS. 9 and 10, wherein spray cooling means is also provided for the delta 26'. This spray system comprises a series of spoke-like spray headers 68 extending from the upper ends of the secondary headers 16 to the apex of the roof, and a plurality of circumferentially extending spray pipes 70 with a plurality of spray nozzles 72 carried thereby. A ring-shaped conduit 74 is joined to the lower or outer edge of the bottom plates 76 of the delta, and coolant outlet openings 78 are formed in the conduit 74 for removing coolant from the coolant space in the delta. Insulated openings 80 are provided for the electrodes 28.

Figure 11:
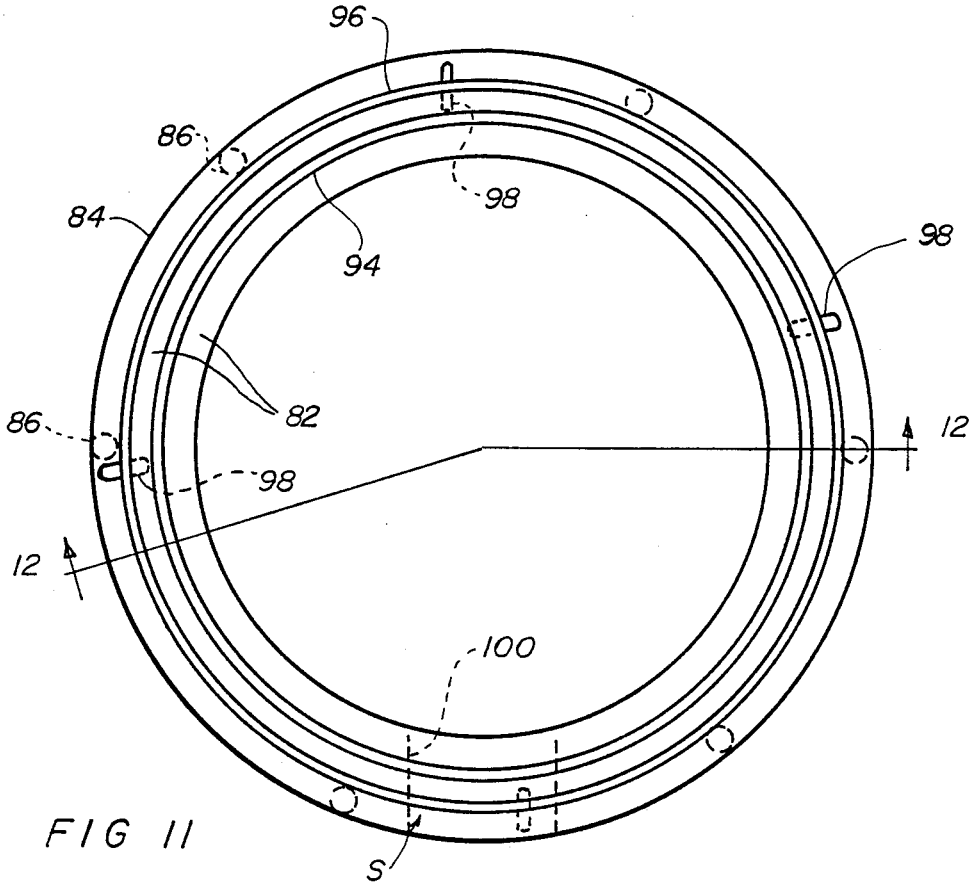
FIG. 11 is a top plan view of a further form of the invention, wherein spray headers are provided in the wall of a furnace.
Figure 12:
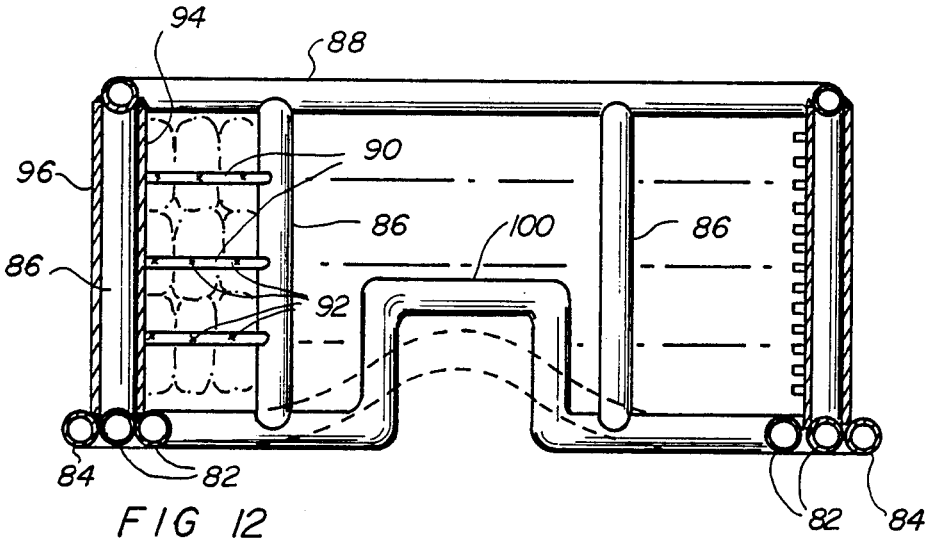
FIG. 12 is a view in section taken along line 12—12 in FIG. 11.

A spray system for cooling the side wall S is illustrated in FIGS. 11 and 12, and comprises a pair of concentrically arranged, contiguous water supply rings or headers 82 extending around the lower wall area, a water return or drain pipe 84 extending in contiguous relationship with the outer header 82, a plurality of upstanding supply headers 86 extending upwardly from the supply pipe to an annular header 88 at the top of the wall, and a plurality of circumferentially extending spray pipes 90 each carrying a plurality of spray nozzles 92 for producing a spray pattern generally as shown in dashed lines in FIG. 12. The upright supply headers are positioned approximately every 30° around the circumference of the wall and take the place of the buck stays normally used. An inner or working plate 94 is supported on the inside of the spray system and an outer cover plate 96 is supported on the outside thereof to define a coolant space or chamber for the coolant fluid. A plurality of scavenger pipes 98 are placed around the circumference of the wall about every 30° for evacuating the coolant from the coolant space via suitable pump means. Rather than a solid working plate, a plurality of individual removable panels could be used, if desired.

The supply headers 82 and drain pipe 84 extending around the bottom of the furnace are deformed upwardly at 100 to provide a door jam. These pipes are shaped as shown in dashed lines 100' in the area of the tap hole.

Figure 13:
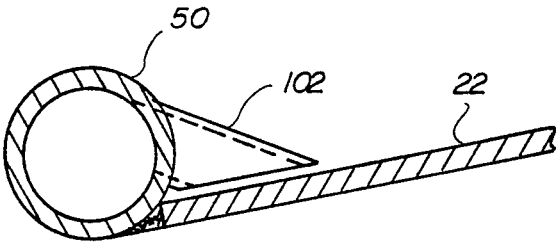
FIG. 13 is an enlarged, fragmentary sectional view of a coolant fluid removal or scavenging means as used in the invention.
Figure 14:
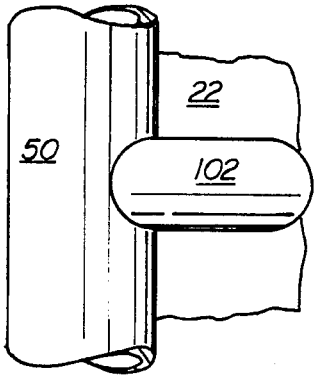
FIG. 14 is a fragmentary plan view of the scavenger of FIG. 13.

A third modification of the invention is shown in FIGS. 13 and 14, wherein the coolant water is evacuated or positively removed by means of scavenger pipes 102 and pump means, rather than through slots 52 as shown in FIGS. 2 and 3.

Figure 15:
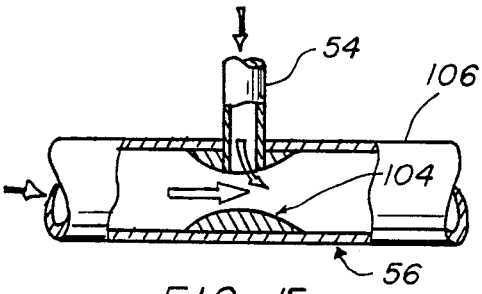
FIG. 15 is a fragmentary sectional view of a venturi pump means suitable for use to evacuate the coolant fluid from the coolant space.

As shown in FIG. 15, the pump means 56 may comprise a venturi 104 in pipe 106, which conveys waste water away from another area of the furnace. The outlet pipes 54 lead to the venturi, whereby when water is flowing through pipe 106, a low pressure is created in pipe 54, evacuating coolant from the coolant space.

The coolant water sprayed from the nozzles 40 forms small droplets, which provide a very large surface area to enhance cooling. Moreover, in the event that the droplets of cooling water do flash to steam, there is no danger of over-pressurization and explosion. Instead, evaporation of the water provides a ten fold increase in cooling effectiveness as compared with prior art flood cooling techniques. Evacuation of the water from the coolant space insures against the build-up of liquid coolant in the coolant space or chamber and maintains a low pressure therein, whereby the chance of coolant leaking into the furnace is extremely remote.

In a test facility embodying the invention, the side and bottom plates of the roof structure comprise $\frac{5}{8}''$ thick steel, while the cover plates are of the same thickness or slightly thinner. The primary header pipe 14 and the outlet conduit 50 are standard 4" pipe with a $\frac{1}{2}''$ thick wall. The spray pipes 18 are standard $1\frac{1}{2}''$ pipes. Where the secondary headers extend parallel with an I-beam 12, the I-beams are approximately 7" deep, while at locations where the I-beams are not accompanied by a spray header, they are approximately 12" deep. The side wall plates 94 in the form of the invention shown in FIGS. 11 and 12 are $\frac{5}{8}''$ thick steel plates, and 3" piping is used around the electrode holes in the form of the invention shown in FIGS. 9 and 10. Scavengers for this form of the invention are spaced about every 90° around the periphery of the delta and communicate with the main scavenger system. To date, this test facility has been successfully operated for 1,800 heats, and has achieved approximately a system. This test facility has achieved approximately a 40% greater cooling rate than was achieved with a prior art flood cooling system. Moreover, the invention only used 2.6 gallons per minute of coolant per square foot of surface area to be cooled as compared with about 4.5 to 5.0 gallons per minute per square foot in a prior art system. The pump in the test facility comprises a venturi through which waste water from another area of the furnace is caused to flow, producing a low pressure in the scavenger system to evacuate the cooling fluid from the coolant space. Operation of the pump is essential to successful operation of the invention, since in the absence of the pump the volume of water in the cooling space becomes unmanageable. In a test conducted on the test facility, the cooling space filled up with water and leakage occurred through the inspection access ports when the pump was not operated.

While the invention has been illustrated and described in detail herein, it is to be understood that various changes in construction and operation can be made without departing from the spirit thereof as defined by the scope of the claims appended hereto.

We claim:

1. In a furnace or vessel for containing molten metal, said furnace or vessel having a roof and a sidewall, at least one of the roof and sidewall including an inner plate exposed to the heat of the metal and an outer plate spaced therefrom and defining with the inner plate an enclosed space therebetween the improvement comprising:

spray means extending into the enclosed space for directing a spray of fluid coolant against the inner plate for maintaining an acceptable temperature at the inner plate; and pump means connected with the enclosed space for evacuating the fluid coolant from the enclosed space after the coolant is sprayed against the inner plate, whereby undesirable build-up of coolant and undesirable build-up of pressure of the coolant in the enclosed space are prevented.

2. In a furnace or vessel as claimed in claim 1, wherein:

the spray means comprises header pipe means connected with a supply of coolant, a plurality of spray pipes connected with the header pipe means to receive coolant therefrom, and a plurality of spray nozzles carried by the spray pipes in substantially uniformly distributed relationship throughout the enclosed space; and said spray means comprises a supporting framework for said inner and outer plates.

3. In a furnace or vessel as claimed in claim 2, wherein:

said inner and outer plates are supported by said spray means to form a substantially one-piece roof structure.

4. In a furnace or vessel as claimed in claim 3, wherein:

access means are provided through at least said outer plates for gaining access to the enclosed space for in situ inspection, maintenance and repair.

5. In a furnace or vessel as claimed in claim 3, wherein:

said roof comprises a plurality of sectors, each extending over a predetermined angular zone of the roof;

each sector comprising inner and outer plates, said spray means being substantially uniformly distributed over each sector; and said sectors being connected to form said one-piece structure.

6. In a furnace or vessel as claimed in claim 3, wherein:

the roof includes a delta with ports through which electrodes extend into the interior of the furnace, said delta comprising inner and outer metal plates defining an enclosed space therebetween; and spray means extending into said enclosed space for directing fluid coolant against the inner plate to cool it.

7. In a furnace or vessel as claimed in claim 1, wherein:

temperature measuring means are associated with the inner plate for monitoring the temperature thereof; and control means are connected with said temperature measuring means for adjusting the rate of flow of coolant in response to the measured temperature.

8. In a furnace for melting or treating molten metal, in which the furnace includes a roof and side wall, said roof having a delta with ports through which electrodes extend into the interior of the furnace for heating the metal, said delta comprising inner and outer metal plates defining an enclosed space therebetween, said inner plate being exposed to the heat of the heated metal, the improvement comprising:

spray means extending into the enclosed space between the inner and outer plates of the delta for spraying a fluid coolant against the inner plate to maintain an acceptable temperature at the inner plate; and pump means connected with the enclosed space for evacuating the fluid coolant from the enclosed space after it is sprayed against the plate, whereby undesirable build-up of coolant and undesirable build-up of pressure of the coolant in the enclosed space are prevented.

9. In a furnace for melting or treating molten metal, in which the furnace includes a roof and side wall, said roof having inner and outer metal plates defining an enclosed space therebetween, said inner plate being exposed to the heat from the molten metal, and means for heating metal confined in the furnace to melt or otherwise treat the metal, the improvement comprising:

spray means extending into the enclosed space for directing spray of fluid coolant against the inner plate to cool the inner plate;

said spray means comprising supply header means connected with a source of fluid coolant, spray pipes connected with the header means to receive fluid coolant therefrom and a plurality of spray nozzles carried by the spray pipes, said spray means forming a supporting framework for the inner and outer plates of the roof, whereby a simplified, lightweight, one-piece roof structure is produced; and pump means connected with the enclosed space for evacuating the fluid coolant from the enclosed space after it is sprayed against the inner plate, whereby undesirable build-up of coolant and undesirable build-up of pressure of the coolant in the enclosed space are prevented.

10. In a furnace as claimed in claim 9, wherein:

said sidewall has inner and outer plates defining an enclosed space therebetween, said inner plate being exposed to the heat of the molten metal in the furnace; and said spray means extends into the enclosed space in the sidewall to cool the inner plate of the sidewall.

11. In a furnace as claimed in claim 8, wherein:

the roof includes inner and outer plates defining an enclosed space therebetween, and said inner plate is exposed to the heat of the molten metal in the furnace; and said spray means extends into the enclosed space between the plates of the roof to cool the inner plate of the roof.

12. In a furnace as claimed in claim 8, wherein:

said sidewall has inner and outer plates defining an enclosed space therebetween, said inner plate being exposed to the heat of the molten metal in the furnace; and spray means extends into the enclosed space in the sidewall to cool the inner plate of the sidewall.

13. In a furnace as claimed in claim 7, wherein:

said temperature measuring means comprise thermocouples embedded in the inner plate.

14. In a furnace as claimed in claim 10, wherein:

said pump means comprises a venturi.

15. In a furnace for melting or treating molten metal, in which the furnace includes a roof and sidewall, said sidewall having inner and outer plates defining an enclosed space therebetween, said inner plate being exposed to the heat of the molten metal in the furnace, and means for heating metal confined in the furnace to melt or otherwise treat the metal, the improvement comprising:

spray means extending into the enclosed space for directing a spray of fluid coolant against the inner plate for maintaining an acceptable temperature at the inner plate; and pump means connected with the enclosed space for evacuating the fluid coolant from the enclosed space after the coolant is sprayed against the inner plate, whereby undesirable build-up of coolant and undesirable build-up of pressure of the coolant in the enclosed space are prevented.

16. In a furnace as claimed in claim 1, wherein:

the inner plate is free of manufactured refractory lining.

17. The method of cooling the roof, sidewall, fume hood, exhaust port and/or feed opening of a metallurgical vessel or furnace for containing molten metal, in which at least one of the roof, sidewall, fume hood, exhaust port and/or feed opening of the furnace includes inner and outer plates defining an enclosed space therebetween, and wherein said inner plate is exposed to the heat of the molten metal in the furnace, comprising the steps of:

spraying a fluid coolant against the inner plate to maintain a desired temperature at the inner plate; and using pump means to evacuate the fluid coolant from the enclosed space after it is sprayed against the inner plate, whereby undesirable build-up of coolant and undesirable build-up of pressure of the coolant in the enclosed space are prevented.

18. The method as claimed in claim 17, wherein:
the fluid coolant is water, and the water is sprayed under pressure against the plate.

19. The method as claimed in claim 17, including the steps of:
measuring the temperature of the inner plate; and
adjusting the flow rate of coolant in response to the measured temperature.

20. The method as claimed in claim 17, including the steps of:
circulating a fluid coolant through a venturi to create a source of low pressure as the pump means;
connecting the space between the plates with the source of low pressure; and
evacuating the coolant fluid from the space by means of the low pressure created in the venturi.

21. The method as claimed in claim 20, including the steps of:
circulating waste water from another area of the furnace through the venturi to create the low pressure.

22. The method of cooling the roof of a metallurgical vessel or furnace for containing molten metal, in which the roof includes inner and outer plates defining an enclosed space therebetween, and in which the inner plate is exposed to the heat of the molten metal, comprising the steps of:
spraying a fluid coolant against the inner plates to maintain a desired temperature at the inner plates; and
using pump means to evacuate the fluid coolant from the enclosed space after it is sprayed against the inner plate, whereby undesirable build-up of coolant and undesirable build-up of pressure of the coolant in the enclosed space are prevented.

23. The method of cooling the sidewall of a metallurgical vessel or furnace for containing molten metal, in which the sidewall includes inner and outer plates defining an enclosed space therebetween, and in which the inner plate is exposed to the heat of the molten metal, comprising the steps of:
spraying a fluid coolant against the inner plate to maintain a desired temperature at the inner plate; and
using pump means to evacuate the fluid coolant from the enclosed space after it is sprayed against the inner plate, whereby undesirable build-up of coolant and undesirable build-up of pressure of the coolant in the enclosed space are prevented.

24. The method of cooling the delta of a metallurigcal vessel or furnace for containing molten metal, in which the delta includes inner and outer plates defining an enclosed space therebetween, and in which the inner plate is exposed to the heat of the molten metal, comprising the steps of:
spraying a fluid coolant against the inner plate to maintain a desired temperature at the inner plate; and
using pump means to evacuate the fluid coolant from the enclosed space after it is sprayed against the inner plate, whereby undesirable build-up of coolant and undesirable build-up of pressure of the coolant in the enclosed space are prevented.

25. In a furnace as claimed in claim 1, wherein:
said pump means comprises a venturi.

26. In a furnace as claimed in claim 1, wherein:
said inner plate is free of manufactured refractory material.

* * * * *

UNITED STATES PATENT AND TRADEMARK OFFICE

CERTIFICATE OF CORRECTION

PATENT NO. : 4,715,042

DATED : December 22, 1987

INVENTOR(S) : Ronald G. Heggart et al.

It is certified that error appears in the above-identified patent and that said Letters Patent is hereby corrected as shown below:

On the title page, after item [22] insert

--- [62] Which is a continuation-in-part of PCT/US84/01636 filed October 12, 1984 --.

Signed and Sealed this

Eighth Day of November, 1988

*Attest:*

DONALD J. QUIGG

*Attesting Officer*

*Commissioner of Patents and Trademarks*